US005524830A

United States Patent [19]

Murase et al.

[11] Patent Number: 5,524,830

[45] Date of Patent: Jun. 11, 1996

[54] CONTINUOUS DISPERSING APPARATUS

[75] Inventors: Yasuhiko Murase; Naoji Mizoguchi; Fumio Yoshida; Kouichi Kanai, all of Tokyo, Japan

[73] Assignee: Toyo Ink Manufacturing Co., Ltd., Tokyo, Japan

[21] Appl. No.: 266,711

[22] Filed: Jun. 28, 1994

Related U.S. Application Data

[63] Continuation-in-part of Ser. No. 118,625, Sep. 10, 1993, abandoned.

[30] Foreign Application Priority Data

Sep. 11, 1992 [JP] Japan ..... 4-269401
Mar. 18, 1993 [JP] Japan ..... 5-58829

[51] Int. Cl.[6] ..... B02C 17/16; B02C 17/18

[52] U.S. Cl. ..... 241/172; 241/179; 241/180; 241/285.1; 241/286

[58] Field of Search ..... 241/153, 171, 241/172, 179, 180, 285.1, 286, 300

[56] References Cited

U.S. PATENT DOCUMENTS

| | | | |
|---|---|---|---|
| 990,167 | 4/1911 | Rouvel | 241/153 |
| 1,788,825 | 1/1931 | Danks | 241/153 X |
| 2,042,254 | 5/1936 | Godinez | 241/172 X |
| 3,018,061 | 1/1962 | Mischanski | 241/172 |
| 3,149,789 | 9/1964 | Szegvari | 241/27 |
| 3,307,792 | 3/1967 | Hughes et al. | 241/172 X |
| 3,311,310 | 3/1967 | Engels et al. | 241/153 |
| 3,446,442 | 5/1969 | Carter | 241/153 X |
| 3,456,888 | 7/1969 | Haigh | 241/153 X |
| 3,527,419 | 9/1970 | Wienert | 241/153 |
| 3,698,647 | 10/1972 | Nye | 241/124 |
| 4,098,465 | 7/1978 | Meller et al. | 241/153 X |
| 4,106,116 | 8/1978 | MacKay | 366/144 |

FOREIGN PATENT DOCUMENTS

| | | | |
|---|---|---|---|
| 738397 | 7/1966 | Canada | 241/172 |
| 173151 | 3/1986 | European Pat. Off. . | |
| 915435 | 11/1946 | France | 241/153 |
| 1250246 | 9/1967 | Germany | 241/172 |
| 52-44053 | 11/1977 | Japan . | |
| 1546140 | 2/1990 | U.S.S.R. | 241/172 |
| 1602571 | 10/1990 | U.S.S.R. | 241/153 |
| 2134816 | 8/1984 | United Kingdom . | |

OTHER PUBLICATIONS

Patent Abstracts of Japan, vol. 7, No. 273 (C–198) (1418) Dec. 6, 1983 and JP–A–58 153 529 (Dainippon Toryo KK), Sep. 12, 1983.

Patent Abstracts of Japan, vol. 7 No. 285 (C–201) (1430) Dec. 20, 1983 and JP–A–58 163 424 (Dainippon Toryo KK), Sep. 28, 1983.

*Primary Examiner*—Timothy V. Eley

*Attorney, Agent, or Firm*—Sughrue, Mion, Zinn, Macpeak & Seas

[57] ABSTRACT

A continuous dispersing apparatus in which stirring vanes in a vessel disperse pulverizing media, wherein mill base containing coarse pigment particles is prevented from being discharged. The apparatus includes a vessel for containing pulverizing media with a supply inlet and a discharge outlet being formed at respective ends of the vessel, a rotating disc mounted on a rotating shaft passing through the vessel, and a partition defining a gap which prevents the passage of the pulverizing media while passing dispersed material, the partition dividing the vessel into a plurality of chambers. Each chamber is provided with at least one stirring device mounted on the rotating shaft. The partition includes a rotating disc releasably fixed to the rotating shaft and a ring-shaped plate releasably fixed to the vessel.

7 Claims, 4 Drawing Sheets

CONTINUOUS DISPERSING APPARATUS

This is a Continuation-in-Part of U.S. patent application Ser. No. 08/118,625, now abandoned filed on Sep. 10, 1993 for "CONTINUOUS DISPERSING APPARATUS", the disclosure of which is incorporated herein by reference.

BACKGROUND OF THE INVENTION

1. Field of the Invention

The invention relates to a continuous dispersing apparatus in which stirring vanes in a vessel disperse pulverizing media.

2. Description of the Related Art

In producing printing ink, paint or the like, a mill base is used, which is formed by dispersing a powdered pigment in a varnish, a solvent or the like at a high concentration. In the dispersing process, a powdered pigment composed of secondary particles formed by agglutinating primary particles of the pigment is pulverized and dispersed in a varnish to produce fine particles not containing coarse particles. Such process is employed to improve the tinting strength of the printing ink and the paint.

To perform the above process, dispersing apparatuses such as a sand mill, a grain mill, a ball mill and the like are known. Dispersing apparatuses capable of preparing printing ink, etc., continuously are designed to continuously supply a mill base material from a material supply inlet that communicates with a vessel, a dispersing process is performed in the vessel, and thereafter the dispersed mill base is discharged continuously from a discharge outlet. However, since the supplied mill base material is not dispersed uniformly in the vessel, so-called "short-pass" occurs whereby mill base containing coarse pigment particles is discharged from the discharge outlet.

The problem of short pass can be prevented to a certain degree by increasing the rate of loading of pulverizing media. However, too high a rate of loading of the media induces choking, which results in an uneven distribution of the media on the discharge outlet side, thereby leading to unstable operation of the apparatus. To avoid this problem, the apparatus is operated at a rate of loading of the pulverizing media of about 75 to 80%.

In addition, U.S. Pat. No. 3,311,310 has been known as a conventional continuous dispersing apparatus as shown in FIG. 3. The conventional continuous dispersing apparatus includes a container 51, an outer mantle 52, a material feed sleeve 53, a stirring mechanism 54 having centrally rotating discs 60, a shaft 65 and circular discs 66, an intake socket 58, an discharge socket 59, counter rings 61, and bearings 62 and 63, in which the separation of the material being ground from the auxiliary grinding bodies is effected by cylindrical gaps formed between the centrally rotating discs 60 and counter rings 61. The stirring mechanism 54 is journalled in bearings 62 and 63 to permit changing the quantity or other characteristics of the auxiliary grinding bodies in an operative machine in zones x, y and z. However, the continuous dispersing apparatus has to be disassembled to overhaul. In case of the overhaul, if the stirring mechanism 54 including the centrally rotating discs 60 and the circular discs 66 are pulled out from the container 51, they may strike against the counter rings 61, whereby edge portion and/or other portions are chipped or broken by contacting each other. In addition, if the pulverizing media including hard materials made of steel, ceramic, stone, or the like runs against the top end portion of the counter rings 61 or the circular discs 66, it may chip or break their corners. Further, since the counter rings 61 can not release from the container 51 and the gaps between the counter rings 61 and the centrally rotating discs 60 are very narrow, it is difficult to overhaul to inspect or exchange the rings and the discs without striking each other and to adjust the gaps when the apparatus is re-assembled.

SUMMARY OF THE INVENTION

In order to solve the above problems encountered by the conventional continuous dispersing apparatus, an object of the invention is to provide an economically advantageous continuous dispersing apparatus with high pulverizing and dispersing efficiency. It is another object of the invention to provide a continuous dispersing apparatus which is easy to assemble and disassemble without breaking parts thereof and to check and adjust the clearance of a small gap between a ring-shaped plate and rotating disc according to the difference of the machining precision of the plate and disc or the deviation of the disc.

The invention is applied to a continuous dispersing apparatus that comprises a vessel for containing pulverizing media; a supply inlet and a discharge outlet formed at respective ends of the vessel, a rotating disc mounted on a rotating shaft passing through the vessel, a partition defining a gap which prevents the passage of the pulverizing media while passing dispersed material, wherein the partition divides the vessel into a plurality of chambers, each chamber having at least one stirring means mounted on the rotating shaft.

BRIEF DESCRIPTION OF THE DRAWINGS

The accompanying drawings illustrate the presently preferred embodiment of the invention and, together with the detailed description of the preferred embodiments provided below, explain the features of the invention, wherein.

BRIEF DESCRIPTION OF THE PREFERRED EMBODIMENTS

Figure 1:
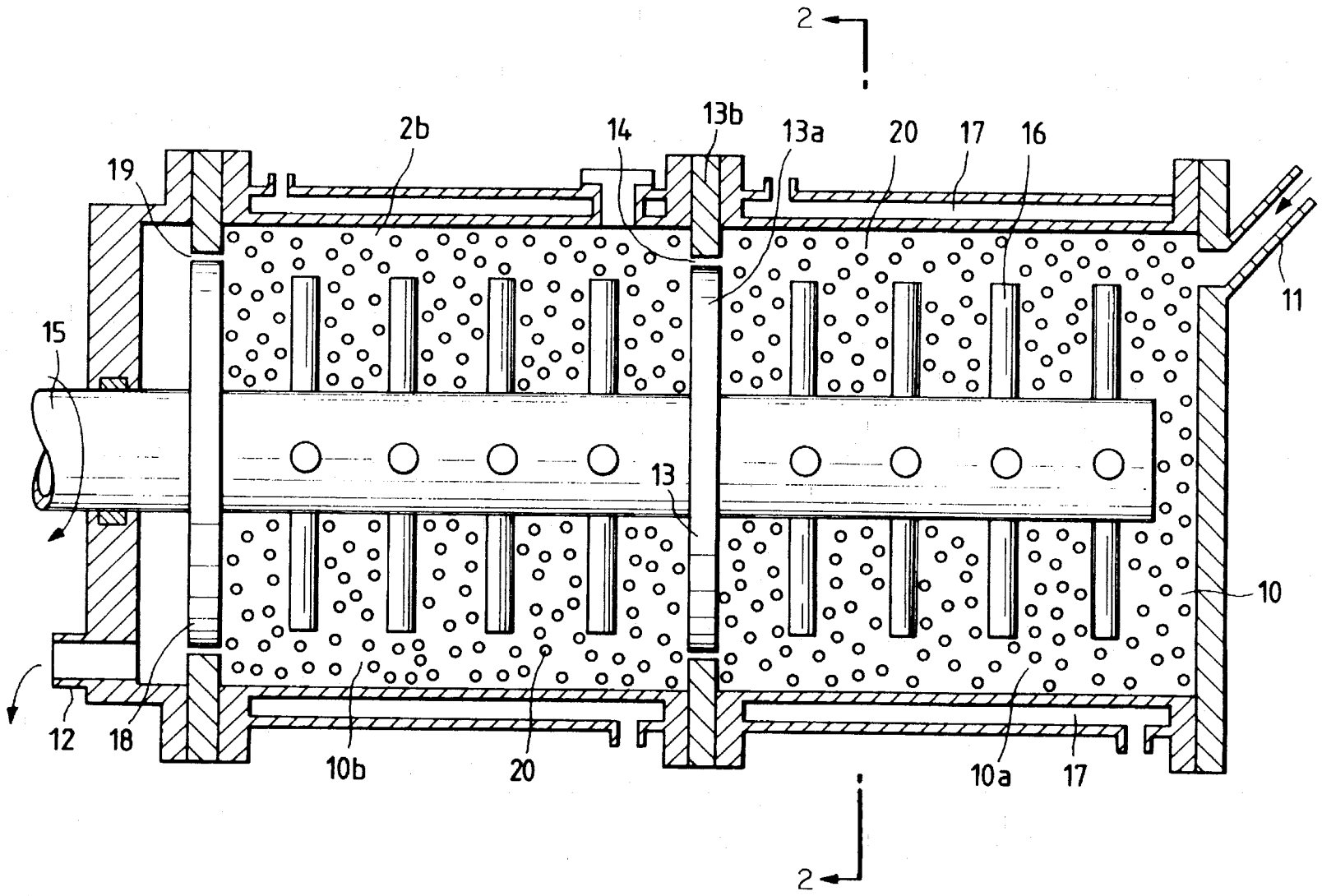
FIG. 1 is a front sectional view of a continuous dispersing apparatus, which is an embodiment of the invention.
Figure 2:
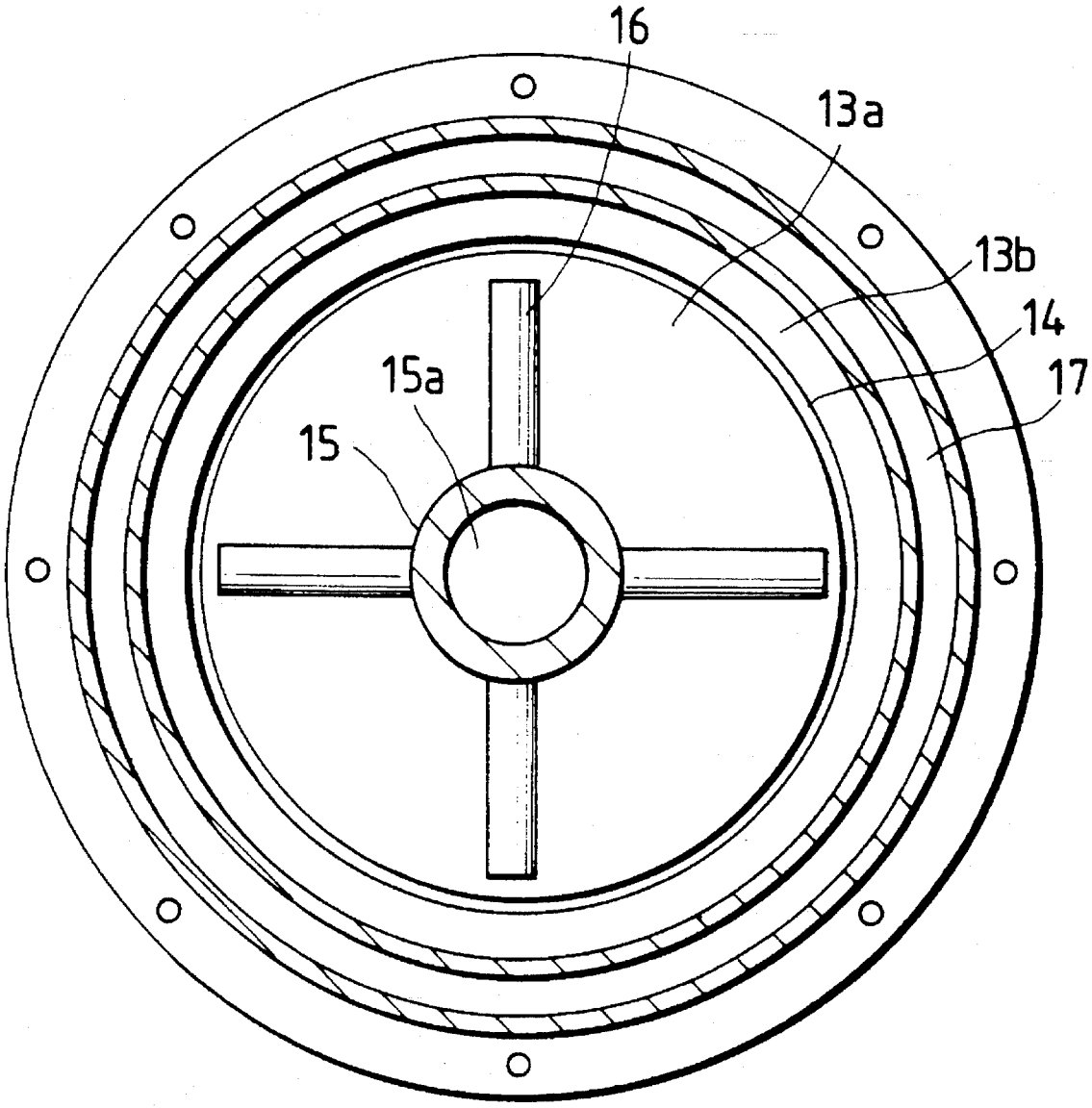
FIG. 2 is a sectional view taken along a long 2—2 of FIG. 1.
Figure 3:
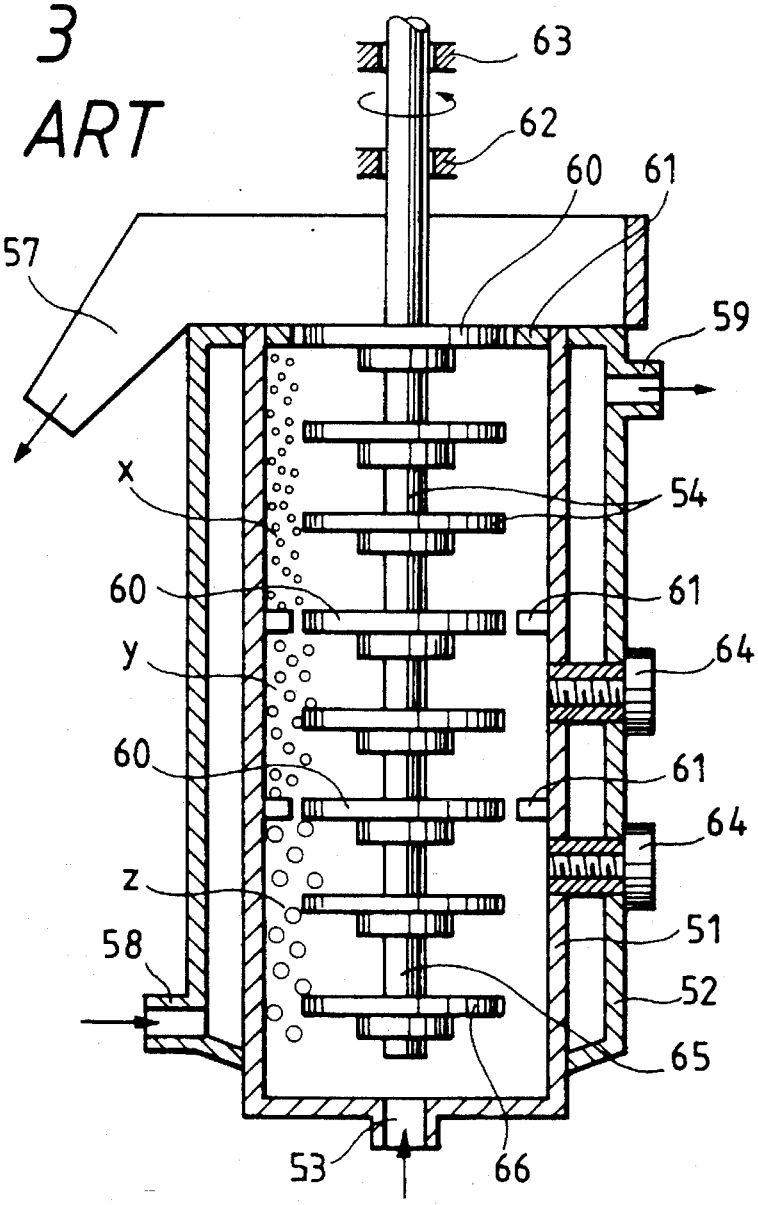
FIG. 3 PRIOR ART
FIG. 3 is a front sectional view of a conventional continuous dispersing apparatus.

The invention will be described with reference to the accompanying drawings.

A continuous dispersing apparatus of the invention has a vessel 10 and a rotating shaft 15 that passes through the vessel 10 via at least one end surface of the vessel 10. While a cylindrical-shaped vessel 10 is shown in the drawings, the section of the vessel may be rectangular, hexagonal, octagonal, or conical. While the capacity of the vessel depends on the size of pulverizing media 20, a capacity of 0.5 liters or more may be practically usable.

Stirring vanes 16 formed by a plurality of coaxially mounted pins are mounted on the rotating shaft 15. While the pin may be circular in section, it may also take other sectional forms such as rectangular, hexagonal, or octagonal.

The stirring vane 16 may be formed of a pair of pins mounted in symmetrical form, or four to eight pins may be mounted coaxially in symmetrical form. The stirring vane 16 may also be a flat disc or conical disc having holes such as to allow the pulverizing media 20 to pass therethrough. The distance between the top of the stirring vane 16 and the inner surface of the vessel 10 is preferably at least three times larger than the diameter of the pulverizing media. The inside of the rotating shaft 15 is a cooling water path 15*a* so that cooling water can circulate therethrough. The rotating shaft is rotated by a rotational power source (not shown) at a peripheral speed of 8 to 12 m/sec. The outside of the vessel 10 is a cooling water flow path 17.

The pulverizing media 20 are made of spherical, or amorphous steel, ceramic, stone, or the like. For example, a spherical medium may have an average grain size of 0.3 to 3 mm. The rate of loading of the pulverizing media 20 is from 70 to 95%, or preferably from 85 to 90%.

A partition 13 includes a rotating disc 13*a* mounted on the rotating shaft 15, and a ring-shaped plate 13*b* fixed to the vessel 10. A slit-shaped gap 14 is formed between the disc 13*a* and the plate 13*b*. The width of the slit does not allow the pulverizing media 20 to pass therethrough, but allows dispersed materials to pass therethrough. If the average size of a spherical pulverizing medium 20 is 1.5 mm, the width of the slit is set to about 0.3 to 0.4 mm.

The vessel 10 is divided into a first chamber 10*a* and a second chamber 10*b* by the partition 13. While two chambers are formed by the partition 13 as shown in FIG. 1, the number of chambers may be larger than two. It is preferable to arrange two to six stirring vanes along the length of the rotating shaft 15 in each chamber.

The gap 14 is preferably formed close to the inner wall of the vessel 10. The reason for this is as follows. When the rotating vanes 16 rotate, the pulverizing media 20 are distributed in the vicinity of the vessel 10 by centrifugal force. Therefore, while the material to be dispersed which is near the vessel 10 is distributed by the pulverizing media 20 efficiently, the material to be dispersed which is near the rotating shaft 15 is dispersed poorly. Thus, the material that has been dispersed satisfactorily must be transferred to the next chamber efficiently.

Figure 4A:
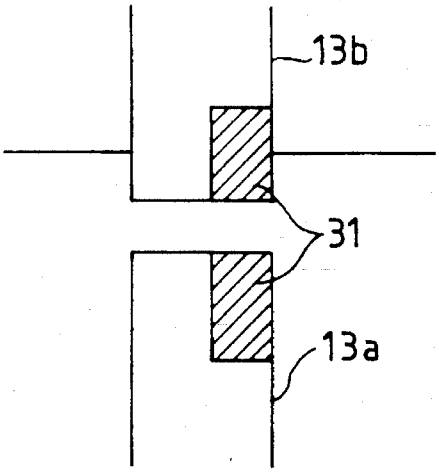
FIGS. 4(*a*) and 4(*b*) are partial enlarged views of FIG. 1 showing around a gap of a partition.
Figure 4B:
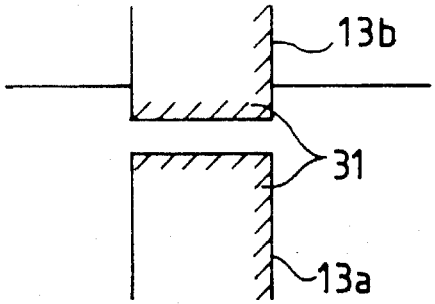

In addition, the dispersed material and the pulverizing media tend to concentrate near the gaps 14 so as to pass therethrough so that the sections of disc 13*a* and ring-shaped plate 13*b* near the gap are worn away. Accordingly, the sections of disc and plate near the gap have to be coated by or made of hard materials 31 such as an ultrahard metal, ceramic or the like as shown in FIGS. 4(*a*) and 4(*b*) in order to prevent abrasions thereto. A preferable ultrahard materials include GTi-30 (commercial name) which is a WC-Co alloy, thermospray M-106 (commercial name) which is an alloy made of 50% of WC-Co, 33% of Ni, 9% of Cr and others, a material including 93% of CrC and 7% of Ni-Cr or the like. In addition, since the hardness of the pulverizing media is from 650 to 1200 in Vickers hardness, the preferable hardness of the ultrahard material is from 720 to 1230 in Vickers hardness.

The partition 13 includes the disc 13*a* releasably fixed to the rotating shaft 15 and the ring-shaped plate 13*b* releasably fixed to the vessel 10. The radius of the disc 13*a* is larger than the radius of gyration of the stirring vane 16 so that a dispersing apparatus can be obtained which is easy to disassemble and maintain.

A material supply inlet 11 for supplying the material to be dispersed is formed at one end of the vessel 10, when the material comprises a powder pigment and a varnish or a solvent or the like, so that the material can be supplied continuously from the material supply inlet 11. The material dispersed in the chambers 10*a* and 10*b* of the vessel 10 is designed to be discharged continuously from a discharge outlet 12 through a slit 19 of a partition 18 that is of the same design as the partition 13.

Pulverizing media of varying grain sizes may be loaded into the respective chambers in the dispersing apparatus of the invention. That is, pulverizing media having a relatively large grain size may be loaded in the first chamber, and pulverizing media having a smaller grain size loaded in the next chamber. Such an arrangement contributes to efficient dispersing.

In this embodiment, the disc 13*a* is releasably fixed to the rotating shaft 15 and the ring-shaped plate 13*b* is releasably fixed to the vessel 10. In addition, the stirring vanes 16 also can be releasable from the rotating shaft 15 so that it is easy to exchange them, In case of disassembling, the vessel 10 is released from the shaft 15 with the disc 13*a*. Since the gap 14 is very narrow and coated by or made of the hard material, the vanes 16 may be easy to break if the vanes 16 strike against the ring-shaped plate 13*b*. Accordingly, in this embodiment, the radius of gyration of the stirring vane 16 is smaller than the radius of the disc 13*a*, and the ring-shaped plate 13*b* is fixed releasably to the vessel 10 so that the dispersing apparatus is easy to disassemble and maintain without breaking its parts.

Figure 5A:
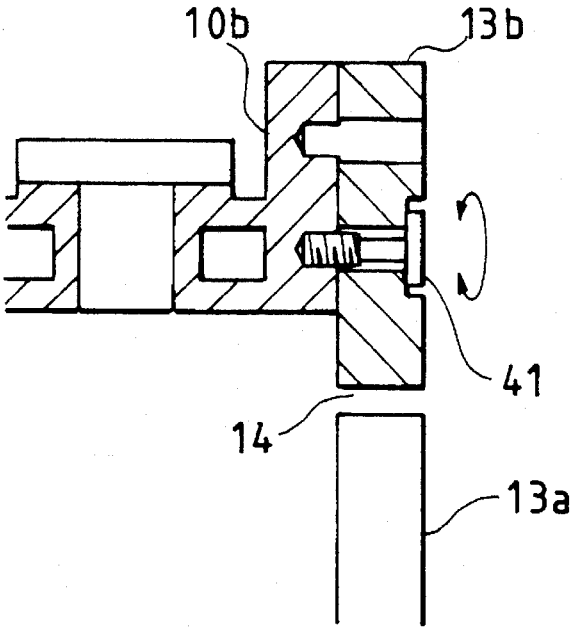
FIGS. 5(*a*) and 5(*b*) are partial front sectional views of the continuous dispersing apparatus showing how to adjust a gap and a position of a ring-shaped plate.
Figure 5B:
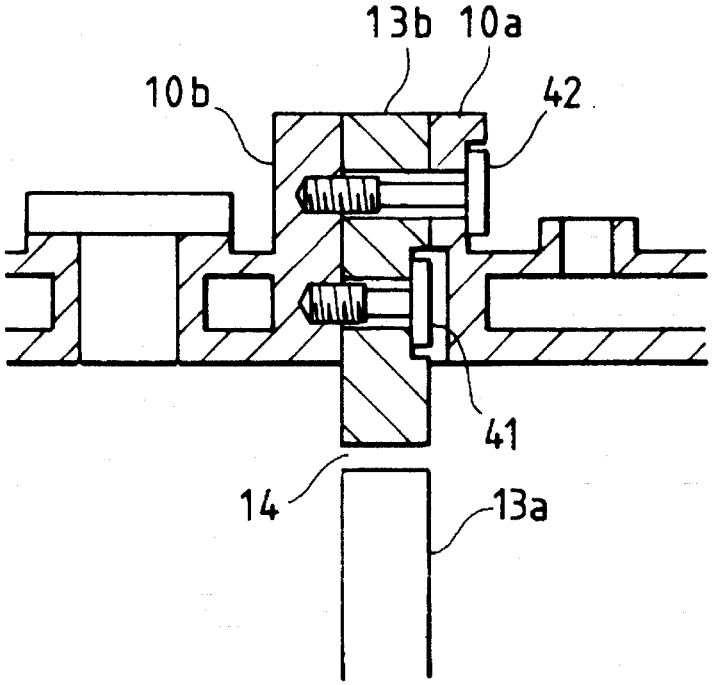

Furthermore, it is possible to adjust the gap 14 and the position of the ring-shaped plate 13*b* in case of assembling or reassembling the apparatus. First, as shown in FIG. 5(*a*), a first screw 41 which is inserted to pass through the ring-shaped plate 13*b* to one side 10*b* of the vessel 10 is turned or loosened so as to adjust the gap 14 and the position of the ring-shaped plate 13*b*. Then, as shown in FIG. 5(*b*), the other side 10*a* of the vessel 10 is attached to the ring-shaped plate 13*b* and, thereafter, a second screw 42 is inserted to pass through the other side 10*a* and the ring-shaped plate 13*b* to the one side 10*b* to fix them. Accordingly, in the continuous dispersing apparatus having such a structure, it is easy to inspect the narrow and subtle distance of the gap 14.

Since the conventional dispersing apparatus is designed so that its vessel is formed of a single chamber, the pulverizing media are subjected to density distribution by the centrifugal force of the rotating vanes such that the material dispersed by the pulverizing media and discharged from the discharge outlet has a small density and is insufficiently dispersed. However, in the dispersing apparatus of the present invention, the vessel is divided into two or more chambers. Therefore, the material to be dispersed undergoes a pulverizing and dispersing process in the first chamber, and only the dispersed material is allowed to pass through the partition thereafter so that the transfer distance of the dispersed material is long, is pulverized and dispersed sufficiently.

Further, since the conventional continuous dispersing apparatus supplies the material to be dispersed continuously, a stream of the dispersed material is produced within the vessel, thereby tending to distribute the pulverizing media locally on the discharge outlet side by the transfer force. According to the invention, which is characterized by dividing the vessel by the partition, such a disadvantage is reduced. As a result, the conventional upper limit of the rate of loading of the pulverizing media, which is about 85%, can be improved to about 90% or more by the dispersing apparatus of the invention.

As a result of the above-described advantages, the invention can improve the productivity of producing a printing ink mill basis by about 50% over the productivity of the conventional dispersing apparatus of the same capacity.

Furthermore, since the assembling and disassembling of the apparatus can be conducted easily and safely, its utility is increased, its maintenance becomes easy and its capacity can be kept for a long time.

What is claimed is:

1. A continuous dispersing apparatus comprising:

a vessel containing pulverizing media;

a supply inlet and a discharge outlet formed at respective ends of said vessel;

a rotary shaft passing through the vessel;

a partition dividing said vessel into a plurality of chambers, said partition defining a gap which prevents passage of said pulverizing media between said chambers and permits passage of a dispersed material, said partition comprising a rotary disc mounted on said rotary shaft and a ring-shaped plate fixed to said vessel, said gap being formed between said rotary disc and said ring-shaped plate, said rotary disc including a top, the distance between the top of said rotary disc and an inner surface of said ring-shaped plate being at least three times smaller than the diameter of said pulverizing media; and at least one stirring means mounted on said rotary shaft in each of said chambers.

2. The continuous dispersing apparatus according to claim 1, wherein said gap is formed close to an inner wall of said vessel.

3. The continuous dispersing apparatus according to claim 1, wherein said partition is formed between said discharge outlet and a one of said plurality of chambers adjacent to said discharge outlet.

4. The continuous dispersing apparatus according to claim 1, wherein said disc is releasably fixed on said rotary shaft, said ring-shaped plate is releasably fixed to said vessel, said stirring means has a length and the radius of said disc is larger than the length of said stirring means.

5. The continuous dispersing apparatus according to claim 4, further comprising:

adjusting means for adjusting a distance of said gap and a position of said ring-shaped plate; and fastening means for fastening said ring-shaped plate to said vessel.

6. The continuous dispersing apparatus according to claim 1, wherein two to six stirring means are arranged in each of said chambers.

7. The continuous dispersing apparatus according to claim 1, wherein said rotary disc and said ring-shaped plate each include a top end portion, at least the top end portion of each of said rotary disc and said ring-shaped plate comprises a hard material which is harder than said pulverizing media.

* * * * *